US005996900A

United States Patent [19]

Ise

[11] Patent Number: 5,996,900

[45] Date of Patent: Dec. 7, 1999

[54] THERMOSTATIC SUBCOOLING CONTROL VALVE

[75] Inventor: Sadatake Ise, Tokyo, Japan

[73] Assignee: Fujikoki Corporation, Tokyo, Japan

[21] Appl. No.: 09/067,814

[22] Filed: Apr. 28, 1998

[30] Foreign Application Priority Data

Aug. 21, 1997 [JP] Japan ..... 9-225303

[51] Int. Cl.[6] ..... G05D 27/00

[52] U.S. Cl. ..... 236/92 B; 236/93 A

[58] Field of Search ..... 236/93 A, 99 J, 236/92 B, 99 R

[56] References Cited

U.S. PATENT DOCUMENTS

| | | | |
|---|---|---|---|
| 2,152,781 | 4/1939 | Wile | 50/23 |
| 3,367,130 | 2/1968 | Owens | 62/222 |
| 4,254,634 | 3/1981 | Akio et al. | 62/217 |
| 4,484,594 | 11/1984 | Alderman | 236/93 A |
| 4,788,828 | 12/1988 | Sato | 236/93 A |
| 4,979,372 | 12/1990 | Tanaka | 62/225 |
| 5,177,973 | 1/1993 | Cholkeri et al. | 236/93 A |
| 5,405,078 | 4/1995 | Yumoto | 236/93 A |
| 5,642,858 | 7/1997 | Kakehashi et al. | 236/92 |

FOREIGN PATENT DOCUMENTS

| | | |
|---|---|---|
| 0279622 | 2/1988 | European Pat. Off. . |
| 0504775 | 3/1992 | European Pat. Off. . |

*Primary Examiner*—William E. Tapolcal
*Attorney, Agent, or Firm*—Baker & Botts, L.L.P.

[57] ABSTRACT

A thermostatic subcooling control valve is disclosed which is capable of enhancing evaporative power of an evaporator in a refrigerating cycle to thereby improve refrigerating capacity of the refrigerating cycle and which is capable of ensuring safety from danger of a high pressure refrigerant and which is capable of attaining improved precision and improved reliability. The thermostatic subcooling control valve according to the present invention comprises a valve body having a pressure-operative portion and a valving element operating portion for sensing temperature and pressure of a refrigerant to operate, and the valve body is contained in a casing provided with a refrigerant inlet connecting portion and a refrigerant outlet connecting portion. Preferably, the casing comprises an entrance casing member having the inlet connecting portion and an exit casing member having the outlet connecting portion, and the casing members are fixedly joined together to thereby contain the valve body.

6 Claims, 3 Drawing Sheets

THERMOSTATIC SUBCOOLING CONTROL VALVE

BACKGROUND OF THE INVENTION

1. Field of the Invention

The present invention relates to a thermostatic subcooling control valve. In particular, it relates to a thermostatic subcooling control valve which senses degree of supercooling (subcooling) of a refrigerant in a refrigerating cycle to control a flow rate of the refrigerant.

2. Description of the Prior Art

Heretofore, a thermostatic expansion valve has generally been used as a flow rate control valve of this type for a refrigerant in a refrigerating cycle. To carry out flow rate control of the refrigerant, heating degree of the evaporated refrigerant at an outlet of an evaporator is sensed by a temperature sensing element and, based on the sensing, the thermostatic expansion valve is operated.

The thermostatic expansion valve is designed, as described above, to have function of controlling the heating degree of the evaporated refrigerant at the outlet of the evaporator to within a predetermined temperature range. Accordingly, no matter how the heating degree of the refrigerant is controlled by the thermostatic expansion valve, it is impossible to attain increase in capability of the evaporator in the refrigerating cycle. In other words, the thermostatic expansion valve is designed to control the heating degree, and hence it has no function of enhancing capability in terms of improvement in refrigerating efficiency.

Further, the thermostatic expansion valve insufficient in terms of safety of the refrigerating cycle. Specifically, for example, even if pressure of the refrigerant in a high pressure-exposed portion in the refrigerating cycle becomes extraordinarily high to incur dangerous condition, the thermostatic expansion valve has no function of protecting an appliance disposed in a high pressure line in the refrigerating cycle from the extraordinarily high pressure because it is not so constructed as to operate based on the pressure in the high pressure-exposed portion in the refrigerating cycle.

To solve the above-described drawbacks of the thermostatic expansion valve, it has been proposed that a subcooling control valve is disposed downstream from a refrigerant condenser in a refrigerating cycle to control degree of supercooling (subcooling) of a high pressure refrigerant.

FIG. 3 shows one form of such a known subcooling control valve. The subcooling control valve 50 comprises a substantially cylindrical valve body 51 and a pressure responsive member 52 located on the top of the valve body 51. The pressure responsive member 52 is divided by a diaphragm 53 into an upper compartment 54 and a lower compartment 55. The valve body 51 comprises an upper valve chamber 56 and a lower valve chamber 57, and the upper valve chamber 56 and the lower valve chamber 57 are in communication with each other via a throttle 58 serving as a valve seat. The upper valve chamber 56 is unified with and in communication with the lower compartment 55 of the pressure responsive member 52.

The upper valve chamber 56 provided with a refrigerant inlet 59 in communication with a condenser, and the lower valve chamber 57 is provided with a refrigerant outlet 60 in communication with an evaporator. To the lower surface of the diaphragm 53, one end of a valve stem 61 is fixedly attached. To the other end of the valve stem 61, a valving element 62 is fixedly attached. The valving element 62 is suspended in the throttle 58, and a compression spring 63 is disposed under the valving element 62 to always bias the valving element 62 upward.

A refrigerant line 64 is located downstream from the refrigerant condenser and upstream to the refrigerant inlet 59 of the subcooling control valve 50, and thereon, a temperature sensing element 65 is placed in contact therewith for detecting a temperature of the refrigerant in the line 64. The temperature sensing element 65 is in communication with the upper compartment 54 of the pressure responsive member 52 via a capillary tube 66. The temperature sensing element 65, the capillary tube 66 and the upper compartment 54 are hermetically filled with a refrigerant, and change in the temperature of the refrigerant flowing in the line 64 in the refrigerating cycle is sensed by the temperature sensing element 65 to act on the diaphragm 53 of the pressure responsive member 52 as change in pressure.

Displacement of the valving element 62 of the subcooling control valve 50 relative to the throttle 58 is controlled according to balance of the pressure exerted on the diaphragm 53 by the upper compartment 54 of the pressure responsive member 52 via the capillary tube 66 on the basis of the temperature sensing by the temperature sensing element 65 versus the pressure in the line 64-the lower compartment 55 of the pressure responsive member 52 and the force of the compression spring 63 which are exerted on the diaphragm 53. According to the displacement of the valving element 62, opening degree of the throttle 58 is determined to thereby control flow rate of the refrigerant passing through the subcooling control valve 50.

In the conventional subcooling control valve 50 constructed as described above, however, it is required that the temperature sensing element 65 for sensing degree of supercooling of the refrigerant flowing downstream form the refrigerant condenser be provided separately from the valve body structure of the subcooling control valve 50 and that the capillary tube 66 be employed for communication between the temperature sensing element 65 and the subcooling control valve 50. Accordingly, in installation operation of the subcooling control valve 50 and the temperature sensing element 65 in the refrigerating cycle, it is inconvenient to place the subcooling control valve 50 and the temperature sensing element 65 at proper positions. In addition, there is undesired possibility of troubles such as breakage of the capillary tube 66 due to inaptitude in handling.

Further, the capillary tube 66 is made of a small-diameter tube and thus likely to undergo blockage during use for some reason to cause a situation where the subcooling control valve 50 is put out of action.

Moreover, the subcooling control valve 50 is so constructed that the temperature change of the refrigerant flowing downstream from the refrigerant condenser in the refrigerating cycle is sensed by means of the temperature sensing element 65 and the temperature change is exerted as pressure change of the refrigerant in the temperature sensing element 65 on the diaphragm 53 of the upper compartment 54 of the pressure responsive member 52 placed at a distance from the temperature sensing element 65 via the capillary tube 66. Accordingly, the subcooling control valve 50 has problems that delay is likely to occur in the response, and that since the temperature sensing element 65 is placed in contact with the refrigerant line 64 in the refrigerating cycle, it is difficult to precisely sense the temperature change of the refrigerant in the refrigerating cycle.

Furthermore, the lower compartment 55 of the pressure responsive member 52 exerts the pressure of the refrigerant in the lower compartment 55 on the diaphragm 53, whereas the upper compartment 54 transforms the temperature of the refrigerant in the line 64 located upstream to the lower compartment 55 into pressure and exerts the pressure on the diaphragm 53. In other words, the diaphragm 53 in the pressure responsive member 52 is operated not based on the temperature and pressure of the refrigerant at the same position but based on the temperatures and pressures of the refrigerant at the different positions in the course of flow. Accordingly, the subcooling control valve disadvantageously tends to have poor sensing and operating accuracy and thus to lack reliability.

SUMMARY OF THE INVENTION

The present invention has been made in view of the problems. It is, therefore, an object of the present invention to provide a thermostatic subcooling control valve which is capable of enhancing evaporative power of an evaporator in a refrigerating cycle to thereby improve refrigerating capacity of the refrigerating cycle and which is capable of ensuring safety from danger of a high pressure refrigerant and which is capable of attaining improved precision and improved reliability.

To achieve the above object, the thermostatic subcooling control valve according to the present invention basically comprises:

a valve body having a pressure-operative portion and a valving element operating portion for sensing temperature and pressure of a refrigerant to operate, the valve body being contained in a casing provided with a refrigerant inlet connecting portion and a refrigerant outlet connecting portion. Preferably, the casing comprises an entrance casing member having the inlet connecting portion and an exit casing member having the outlet connecting portion, and the casing members are fixedly joined together to thereby contain the valve body.

More preferably, in the thermostatic subcooling control valve according to the present invention, the pressure-operative portion of the valve body comprises a disc-shaped base having an opening at its center, a hemispherical lid placed on the disc-shaped base, a funnel-shaped receiving plate placed under the disc-like base and centrally provided with an internally threaded port, and a diaphragm interposed between the disc-like base and the receiving plate and centrally provided with a stopper plate on its lower surface, and an operating chamber defined by the disc-like base and the hemispherical lid is hermetically filled with a gaseous refrigerant.

In a preferred embodiment of the thermostatic subcooling control valve according to the present invention, the pressure-operative portion of the valve body is placed in the entrance casing member in such a manner that the top of the hemispherical lid of the pressure-opeartive portion faces the inlet connecting portion, and preferably, the entrance casing member has a hemispherical shape and is provided with the inlet connecting portion at its top to define a refrigerant flowing space between the entrance casing member and the hemispherical lid of the pressure-operative portion contained therein.

In another preferred embodiment of the thermostatic subcooling control valve according to the present invention, the valving element operating portion of the valve body comprises a tubular support fixedly held in the casing, and a valve sliding hole is provided in an upper portion of the tubular support, and a valve chamber is defined under the valve sliding hole, and a throttle is formed under the valve chamber, and a spring chamber is defined under the throttle, and a valving element is vertically slidably inserted in the valve sliding hole, and the valving element has its upper end pressed against the stopper plate of the diaphragm and has its bottom provided with a thin connecting rod protruding therefrom, and the connecting rod downward extends through the throttle into the spring chamber and abuts upon an upper holder of a compression spring placed in the spring chamber and is held on the upper holder.

In still another preferred embodiment of the thermostatic subcooling control valve according to the present invention, the tubular support has its upper end portion provided with an external thread, and the external thread is screwed into the internal thread provided in the lower portion of the funnel-shaped receiving plate to support the pressure-operative portion, and preferably, the tubular support is provided with a plurality of refrigerant passages radially extending from the valve chamber for communication between the valve chamber and the outside thereof and also provided with a plurality of refrigerant inflow ports upward extending from the refrigerant passages to open to an operating chamber under the diaphragm to introduce an influent refrigerant around the pressure-operative portion into the valve chamber through the refrigerant passages and also into the operating chamber through the refrigerant passages and the refrigerant inflow ports.

The thermostatic subcooling control valve of the present invention which is designed as described above has such a construction that the pressure-operative portion in the casing is hermetically filled with the refrigerant for temperature sensing. By virtue of this, it requires neither a temperature sensing element for sensing a temperature of a refrigerant circulating through a refrigerating cycle nor a capillary tube for connecting the temperature sensing element to a valve. Accordingly, the thermostatic subcooling control valve may be formed compactly with a reduced number of parts.

Further, the valve body has such a construction that it is contained in the casing, that the pressure-operative portion thereof has the hemispherical lid, which is hermetically filled with the temperature sensing refrigerant, and that the top of the hemispherical lid faces the inlet connecting portion. Accordingly, the circulating refrigerant flowing into the valve through the inlet connecting portion first impinges upon the top portion of the hemispherical lid and then flows along the whole periphery of the hemispherical lid. The temperature of the circulating refrigerant is thereby sensed through the whole surface of the hemisphere of the hemispherical lid and transmitted to the refrigerant hermetically contained in the hemispherical lid. The temperature of the circulating refrigerant is transmitted to the hermetically contained refrigerant with excellent sensitivity, and therefore, a thermostatic subcooling control valve can be provided which has excellent responsivity to the temperature of the circulating refrigerant.

Moreover, the portion for sensing the temperature of the circulating refrigerant and the portion for sensing the pressure of the circulating refrigerant are defined adjacently to each other. By virtue of this, the temperature and the pressure of the circulating refrigerant at substantially the same position are sensed in parallel.

DESCRIPTION OF THE PREFERRED EMBODIMENT

In the following, one embodiment of the thermostatic subcooling control valve according to the present invention will be described in detail with reference to the accompanying drawings.

Figure 1:
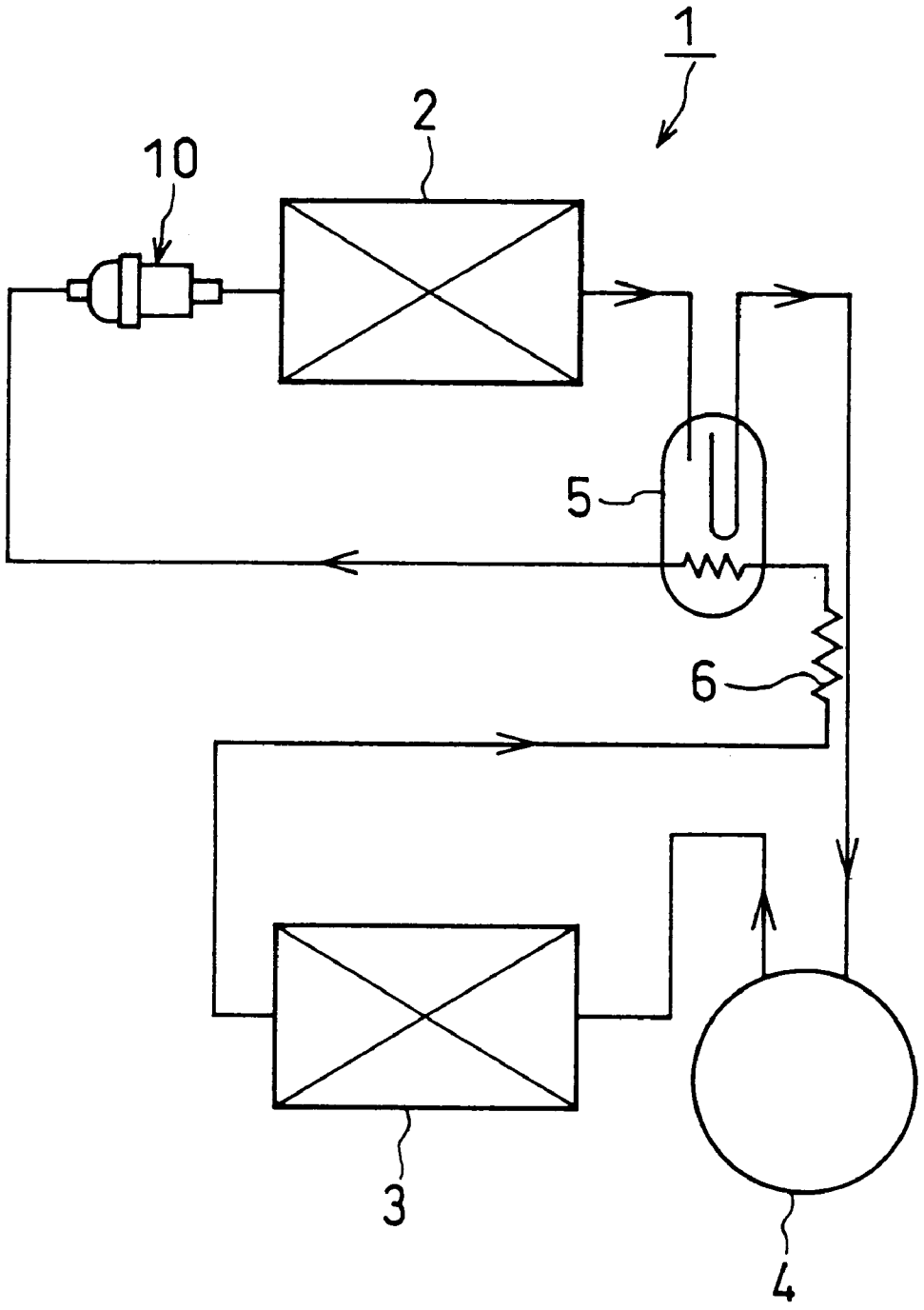
FIG. 1 is a conceptional representation of a refrigerating cycle provided with an embodiment of the thermostatic subcooling control valve according to the present invention.

FIG. 1 is a conceptional representation of a refrigerating cycle provided with the thermostatic subcooling control valve according to the embodiment. The refrigerating cycle 1 comprises a refrigerant evaporator 2, a refrigerant condenser 3 and a refrigerant compressor 4. The refrigerant evaporator 2, the refrigerant condenser 3 and the refrigerant compressor 4 are connected via piping to circulate a refrigerant through the refrigerating cycle 1. The refrigerant condenser 3 is connected downstream from the refrigerant compressor 4. A heat exchanger 6 is provided downstream from the refrigerant condenser 3 for heat-exchanging between the refrigerant in a line leading to the refrigerant compressor 4 and the refrigerant in a line leading out of the refrigerant condenser 3, and an accumulator 5 is connected downstream from the heat exchanger 6. The accumulator 5 is for vapor-liquid separation of the refrigerant from the refrigerant evaporator 2 and for heat exchange between the refrigerant subjected to the vapor-liquid separation and the refrigerant from the heat exchanger 6.

In a line between the accumulator 5 and the refrigerant evaporator 2, the thermostatic control valve 10 of this embodiment is disposed. The liquid refrigerant released from the refrigerant condenser 3 is subjected to heat-exchange by the heat exchanger 6 and then by the accumulator 5. Thereafter, temperature and pressure of the refrigerant are sensed by means of the thermostatic subcooling control valve 10 to control flow rate of the refrigerant entering the refrigerant evaporator 2. The refrigerant from the refrigerant evaporator 2 is subjected to vapor-liquid separation by the accumulator 5 and compressed by the compressor 4 to continue circulation.

Figure 2:
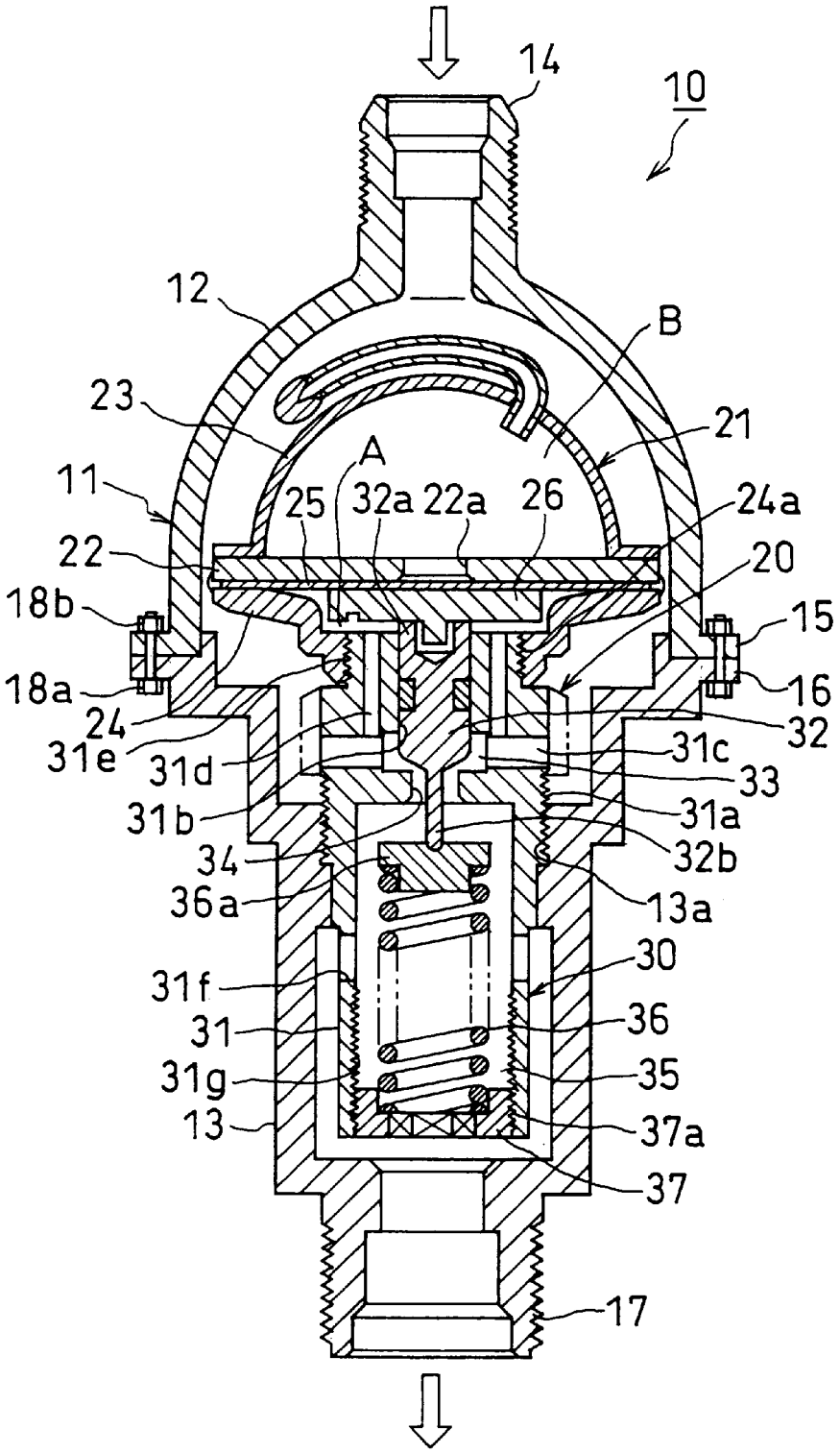
FIG. 2 is a vertical sectional view of the thermostatic subcooling control valve in FIG. 1.
Figure 3:
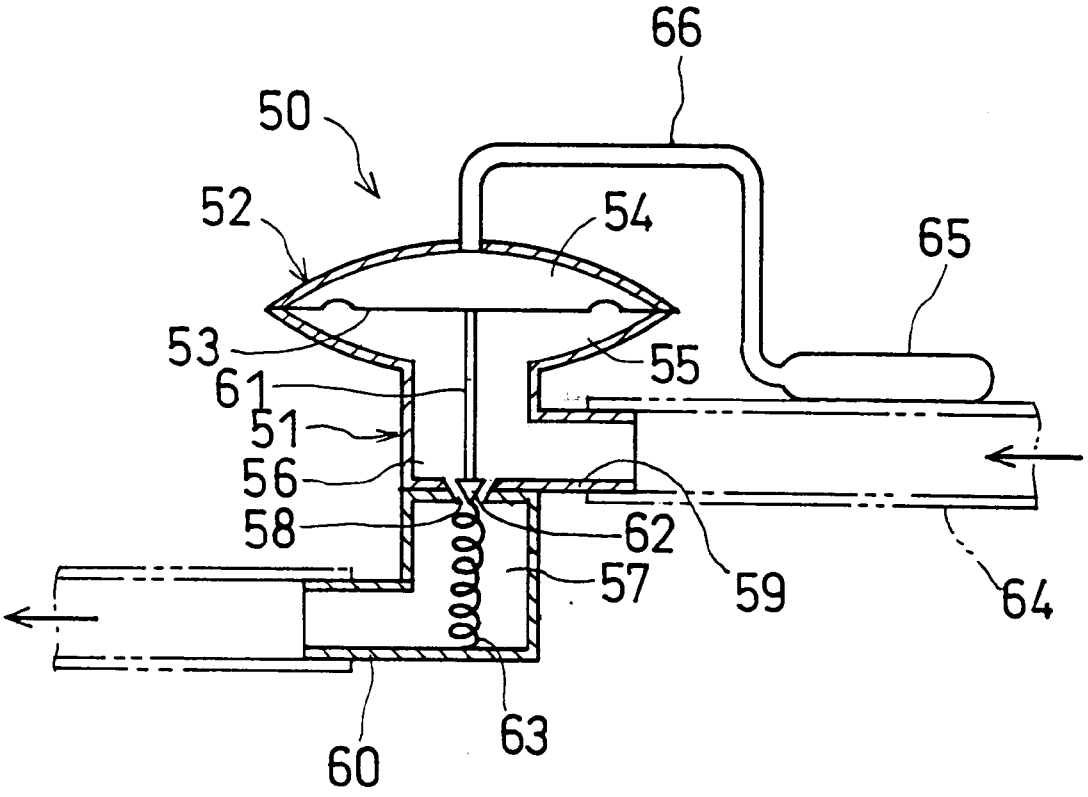
FIG. 3 is a vertical sectional view of a conventional thermostatic subcooling control valve.

FIG. 2 shows a vertical sectional view of the thermostatic subcooling control valve 10 according to this embodiment. The thermostatic subcooling control valve 10 comprises an internally placed valve body 20 and a casing 11 enclosing the valve body 20.

The casing 11 comprises an entrance casing member 12 and an exit casing member 13. The entrance casing member 12 has a dome-like shape and is provided with an inlet connecting portion 14 at the top of the dome and a joint brim 15 at the bottom of the dome. The exit casing member 13 has a tubular shape having its one end portion expanded and is provided with a joint brim 16 at the end of the expanded portion and an outlet connecting portion 17 at the other end. The entrance casing member 12 and the exit casing member 13 are fixedly butt-joined together with the valve body 20 contained therein in such a manner that the two joint brims 15, 16 are put together and tightened by means of bolts and nuts 18*a*, 18*b*. In this connection, the joint brims 15, 16 may be butt-joined by welding or combination of welding with bolting. The inlet connecting portion 14 is connected to the line from the refrigerant condenser 3, and the outlet connecting portion 17 is connected to the line to the entrance of the refrigerant evaporator 2.

The valve body 20 comprises a pressure-operative portion 21 located in the entrance casing member 12 and a valving element operating portion 30 located in the exit casing member 13. The pressure-operative portion 21 comprises a disc-shaped base 22 having an opening 22*a* at its center, a hemispherical lid 23 placed on the disc-shaped base 22, a funnel-shaped receiving plate 24 placed under the disc-like base 22 and centrally provided with an internally threaded port 24*a*, and a diaphragm 25 interposed between the disc-like base 22 and the funnel-shaped receiving plate 24 and centrally provided with a stopper plate 26 on its lower surface. The disc-like base 22, the hemispherical lid 23, and the receiving plate 24 are circumferentially joined together by welding and thus unified. An operating chamber B defined by the disc-like base 22 and the hemispherical lid 23 is hermetically filled with a gaseous refrigerant, and pressure of the gaseous refrigerant is exerted on the upper surface of the diaphragm 25 via the center opening 22*a*.

The valving element operating portion 30 comprises a tubular support 31. The tubular support 31 is circumferentially provided with an external thread 31*a* in its middle portion, and the external thread 31*a* is screwed into an internal thread 13*a* formed in the inner circumferential surface of the exit casing member 13 to thereby fixedly place the tubular support 31 in the exit casing member 13. In an upper portion of the tubular support 31, a valve sliding hole 31*b* is provided. A valve chamber (valve chest) 33 is defined under the valve sliding hole 31*b*, and a throttle 34 is formed under the valve chamber 33, and a spring chamber 35 is defined under the throttle 34.

A valving element 32 is vertically slidably inserted in the valve sliding hole 31*b*. The valving element 32 has its upper end 32*a* pressed against the stopper plate 26 of the diaphragm 25 and has its bottom provided with a thin connecting rod 32*b* protruding therefrom. The connecting rod 32*b* downward extends through the throttle 34 into the spring chamber 35 and abuts upon an upper holder 36*a* of a compression spring 36 placed in the spring chamber 35 and is held on the upper holder.

The tubular support 31 has its upper end portion provided with an external thread 31*e*, and the external thread 31*e* is screwed into the internal thread 24*a* provided in the lower portion of the funnel-shaped receiving plate 24 to support the pressure-operative portion 21. The tubular support 31 is provided with a plurality of refrigerant passages 31*c* radially extending from the valve chamber 33 for communication between the valve chamber 33 and the outside thereof, and it is provided with a plurality of refrigerant inflow ports 31*d* upward extending from the refrigerant passages 31*c* to open to an operating chamber A under the diaphragm 25. The influent refrigerant around the pressure-operative portion 21 is introduced into the valve chamber 33 through the refrigerant passages 31*c* and also introduced into the operating chamber A through the refrigerant passages 31*c* and the refrigerant inflow ports 31*d* to exert its pressure on the lower surface of the diaphragm 25.

In a lower portion of the tubular support 31, a plurality of openings 31*f* are provided for communication between the spring chamber 35 and the outside of the tubular support 31. An internal thread 31*g* is provided in a lower portion of the spring chamber 35, and an external thread 37*a* provided in a circumferential surface of a spring position adjusting member 37 is screwed into the internal thread 31*g* from below to adjust biasing force of the compression spring 36. Further, this embodiment is characterized in that position of the spring 36 can be adjusted externally. The refrigerant which has flowed in the valve chamber 33 is introduced into the spring chamber 35 through the throttle 34 and led from the spring chamber 35 through the openings 31*f* to the outlet connection portion 17.

When the thermostatic subcooling control valve 10 of this embodiment which is constructed as described above is incorporated as an expansion valve in a refrigerating cycle as shown in FIG. 1, a liquid refrigerant having high temperature and high pressure which has been compressed in a refrigerant compressor 4 passes through a refrigerant condenser 3 and is subjected to heat exchange by a heat-exchanger 6 and an accumulator 5 and thereby supercooled. The supercooled refrigerant is led to the thermostatic subcooling control valve 10 and flows into the inlet connecting portion 14 (of the entrance casing member 12) of the casing 11 of the thermostatic subcooling control valve 10. The refrigerant which has flowed into the inlet connecting portion 14 flows down from vicinities of the top of the hemispherical lid 23 along the hemispherical lid to the refrigerant passages 31*c* of the tubular support 31, and from the refrigerant passages 31*c*, it flows into the valve chamber 33 and into the operating chamber A through the refrigerant inflow ports 31*d*.

In this condition, if the refrigerant which has flowed into the thermostatic subcooling control valve 10 is supercooled to a predetermined degree of subcooling, the refrigerant in the operating chamber B is also cooled by the liquid refrigerant of the refrigerating cycle to a temperature commensurate with the subcooling. Accordingly, pressure of the gaseous refrigerant in the operating chamber B is low.

In such a condition that the pressure of the gaseous refrigerant in the operating chamber B is low as described above, if total of the pressure of the influent liquid refrigerant in the operating chamber A which upward pushes the diaphragm 25 and the biasing force of the spring 36 (the force of the spring 36 which upward pushes the stopper plate 26 via the valving element 32) is set to be greater than the pressure of the refrigerant in the operating chamber B which downward pushes the diaphragm 25, the diaphragm 25 is upward moved and thus the valving element 32 is also moved upward to open the valve.

In the valve open condition, the liquid refrigerant which has flowed in the valve chamber 33 flows therefrom through the throttle 34 into the spring chamber 35 while adiabatically expanding, and from the spring chamber 35, it flows out of the thermostatic subcooling control valve 10 through the outlet connecting portion 17. Then, it flows into the refrigerant evaporator 2.

If degree of subcooling of the liquid refrigerant flowing into the inlet connecting portion 14 of the thermostatic subcooling control valve 10 becomes insufficient, i.e., if temperature of the liquid refrigerant becomes high, the refrigerant in the operating chamber B is expanded to increase its gas pressure. In consequence, the pressure which downward pushes the diaphragm 25 increases. When the pressure becomes in excess of the total of the pressure of the influent liquid refrigerant in the operating chamber A which upward pushes the diaphragm 25 and the upward biasing force of the spring 36, the valving element 32 is downward moved. The opening area of the throttle 34 is narrowed by the valving element 32. If the pressure in the operating chamber B is further increased, the throttle 34 is eventually closed with the valving element 32 to stop the refrigerant from flowing into the refrigerant evaporator 2.

As described above, in the thermostatic subcooling control valve 10 of this embodiment, the operating chamber B is hermetically filled with the gaseous refrigerant so that optimum operating pressure is obtained in the operating chamber B at a predetermined temperature. Accordingly, when the pressure of the liquid refrigerant is in pre-set ordinary operating condition, the valving element 32 is moved depending upon the temperature and pressure of the influent liquid refrigerant to control flow rate of the liquid refrigerant. However, when the liquid refrigerant has high temperature and pressure exceeding preset values and thus pressure in a high pressure-exposed portion of the refrigerating cycle approaches and is likely to exceed critical pressure, the diaphragm 25 is upward pushed by the pressure of the refrigerant circulating through the refrigerating cycle to lift the valving element 32. Consequently, the refrigerant rapidly flows out toward the low pressure portion (toward the refrigerant evaporator).

The thermostatic subcooling control valve 10 of this embodiment is designed, when incorporated in a refrigerating cycle, to control subcooling degree of a refrigerant having high temperature and pressure which has been condensed to a liquid in a condenser, as opposed to a thermostatic expansion valve designed to control degree of heating of a refrigerant by an evaporator, and therefore, the thermostatic subcooling control valve 10 of this embodiment enables the evaporator to fully exhibit its capability even if the evaporator is in the maximum load condition.

Further, the thermostatic subcooling control valve 10 of this embodiment is designed, when incorporated in a refrigerating cycle, to control subcooling degree of a liquid refrigerant having high temperature and high pressure in a high pressure-exposed portion of the refrigerating cycle, and therefore, by increasing the subcooling degree, it is possible to increase refrigerating capacity of the refrigerating cycle. In relation to this, it is possible to realize a refrigerating cycle reduced in size as a whole.

By increasing the subcooling degree of the liquid refrigerant, generation of flash gas from the refrigerant is suppressed and thus reduction of flow rate of the liquid refrigerant at the time of passage thereof through the throttle (orifice) due to the generation of flash gas is prevented. In addition, generation of noise is prevented at the time of passage of the refrigerant through the throttle (orifice).

Moreover, the thermostatic subcooling control valve 10 of this embodiment has such a construction that the pressure-operative portion 21 in the casing 11 of the valve 10 is hermetically filled with the refrigerant for temperature sensing. By virtue of this, it requires neither a temperature sensing element for sensing a temperature of a refrigerant circulating through a refrigerating cycle nor a capillary tube for connecting the temperature sensing element to a valve. Accordingly, the thermostatic subcooling control valve 10 may be formed compactly with a reduced number of parts. Further, since neither a capillary tube nor a temperature sensing element is required, problems as found in conventional subcooling control valves, such as breakage of a capillary tube, insufficiency in heat retaining property of a temperature sensing and failure in installation are not caused.

Furthermore, the valve body 20 of the thermostatic subcooling control valve 10 of this embodiment has such a construction that it is contained in the casing 11, that the pressure-operative portion 21 thereof has the hemispherical lid 23, which is hermetically filled with the temperature sensing refrigerant, and that the top of the hemispherical lid 23 faces the inlet connecting portion 14. Accordingly, the circulating refrigerant flowing into the valve through the inlet connecting portion 14 first impinges upon the top portion of the hemispherical lid 23 and then flows along the whole periphery of the hemispherical lid 23. The temperature of the circulating refrigerant is thereby sensed through the whole surface of the hemisphere of the hemispherical lid 23 and transmitted to the refrigerant hermetically contained in the hemispherical lid 23. The temperature of the circulating refrigerant is transmitted to the hermetically contained refrigerant with excellent sensitivity, and therefore, a thermostatic subcooling control valve can be provided which has excellent responsivity to the temperature of the circulating refrigerant.

Still further, the portion for sensing the temperature of the circulating refrigerant (operating chamber B) and the portion for sensing the pressure of the circulating refrigerant (operating chamber A) are defined adjacently to each other. By virtue of this, the temperature and the pressure of the circulating refrigerant at substantially the same position are sensed in parallel. Accordingly, a thermostatic subcooling control valve can be provided which has high sensing and operating accuracy.

As understood from the above description, the thermostatic subcooling control valve according to the present invention comprises the temperature sensing portion and the pressure sensing portion therein without requiring a temperature sensing element for sensing a temperature of a circulating refrigerant in a refrigerating cycle and a capillary tube, and accordingly, it has excellent responsivity to the temperature of the circulating refrigerant and exhibits high sensing and operating accuracy.

What is claimed is:

1. A thermostatic subcooling control valve comprising:

a valve body having a pressure-operative portion and a valving element operating portion for sensing temperature and pressure of a refrigerant to operate, said valve body being contained in a casing provided with a refrigerant inlet connecting portion and a refrigerant outlet connecting portion, said casing including an entrance casing portion having said inlet connecting portion and an exit casing member having said outlet connecting portion, said casing members being fixedly joined together to thereby contain said valve body, wherein said pressure-operative portion of said valve body comprises a disc-shaped base having an opening at its center, a lid received and hermetically sealed to said disc-shaped base and defining with said disc-shaped base an operating chamber, a receiving plate placed under said disc-shaped base and centrally provided with an internally threaded port, and a diaphragm interposed between said disc-shaped base and said receiving plate and centrally provided with a stopper plate on its lower surface, and wherein said operating chamber defined by said disc-shaped base and said lid is filled with a gaseous refrigerant.

2. The thermostatic subcooling control valve according to claim 1, wherein said pressure-operative portion of said valve body is placed in said entrance casing member in such a manner that the top of said lid of said pressure-opeartive portion faces said inlet connecting portion.

3. The thermostatic subcooling control valve according to claim 2, wherein said entrance casing member has a hemispherical shape and is provided with said inlet connecting portion at its top to define a refrigerant flowing space between said entrance casing member and said lid of said pressure-operative portion contained therein.

4. The thermostatic subcooling control valve according to claim 1, wherein said valving element operating portion of said valve body comprises a tubular support fixedly held in said casing, and a valve sliding hole is provided in an upper portion of said tubular support, and a valve chamber is defined under said valve sliding hole, and a throttle is formed under said valve chamber, and a spring chamber is defined under said throttle, and wherein a valving element is vertically slidably inserted in said valve sliding hole, and said valving element has its upper end pressed against said stopper plate of said diaphragm and has its bottom provided with a thin connecting rod protruding therefrom, and said connecting rod downward extends through said throttle into said spring chamber and abuts upon an upper holder of a compression spring placed in said spring chamber and is held on the upper holder.

5. The thermostatic subcooling control valve according to claim 4, wherein said tubular support has its upper end portion provided with an external thread, and said external thread is screwed into said internal thread provided in the lower portion of the receiving plate to support said pressure-operative portion.

6. The thermostatic subcooling control valve according to claim 4, wherein said tubular support is provided with a plurality of refrigerant passages radially extending from said valve chamber for communication between said valve chamber and the outside thereof and also provided with a plurality of refrigerant inflow ports upward extending from said refrigerant passages to open to an operating chamber under said diaphragm to introduce an influent refrigerant around the pressure-operative portion into said valve chamber through said refrigerant passages and also into said operating chamber through said refrigerant passages and said refrigerant inflow ports.

* * * * *